US005404895A

United States Patent [19]

Yamauchi et al.

[11] Patent Number: 5,404,895

[45] Date of Patent: Apr. 11, 1995

[54] DISHWASHER WITH IMPROVED PIPING STRUCTURE

[75] Inventors: Toshiaki Yamauchi, Tajimi; Masanobu Yanagihara, Gifu; Yoshio Ikeda, Kasugai; Takeshi Tsunekawa, Aichi; Hiroshi Sakata, Seto; Tatsuya Saitoh, Nagoya, all of Japan

[73] Assignee: Kabushiki Kaisha Toshiba, Kawasaki, Japan

[21] Appl. No.: 205,479

[22] Filed: Mar. 4, 1994

[30] Foreign Application Priority Data

Mar. 4, 1993 [JP] Japan ..... 5-043611

[51] Int. Cl.[6] ..... B08B 13/00

[52] U.S. Cl. ..... 134/201; 312/228; 68/3 R

[58] Field of Search ..... 134/56 D, 57 D, 58 D, 134/201; 312/228; 68/3 R; 137/343, 355.16, 374, 590

[56] References Cited

U.S. PATENT DOCUMENTS 2,690,949 10/1954 Reifenberg .
3,092,134 6/1963 Allen et al. ..... 134/580 X
3,109,709 6/1965 Dutcher et al. .
3,862,786 1/1975 Brezosky .
4,295,692 10/1981 Jenkins ..... 312/218

FOREIGN PATENT DOCUMENTS 1185646 4/1985 Canada ..... 134/56 D
0400466 12/1990 European Pat. Off. .
1-86960 6/1989 Japan .
3-49059 5/1991 Japan .

*Primary Examiner*—Frankie L. Stinson
*Attorney, Agent, or Firm*—Cushman Darby & Cushman

[57] ABSTRACT

A dishwasher includes a casing having right-hand and left-hand side walls and two concave portions formed in the lower portions of the side walls, respectively. The concave portions have pipe passing openings formed in walls defining the concave portions, respectively. Each pipe passing opening is contiguous to the interior of the casing. A main feed pipe is disposed in the casing and has two ends. A water supply connecting pipe has a part located in either one of the concave portions and caused to pass through the pipe passing opening in the condition that the part has been located in either concave portion so that one of its two ends is guided into the casing and connected to the end of the main feed pipe located in the casing.

9 Claims, 11 Drawing Sheets

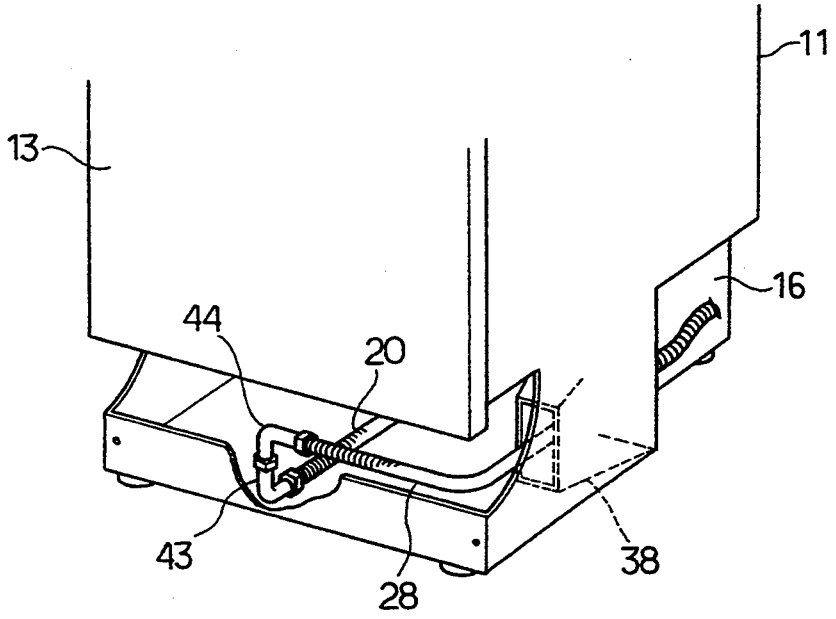
FIG.10
FIG.11
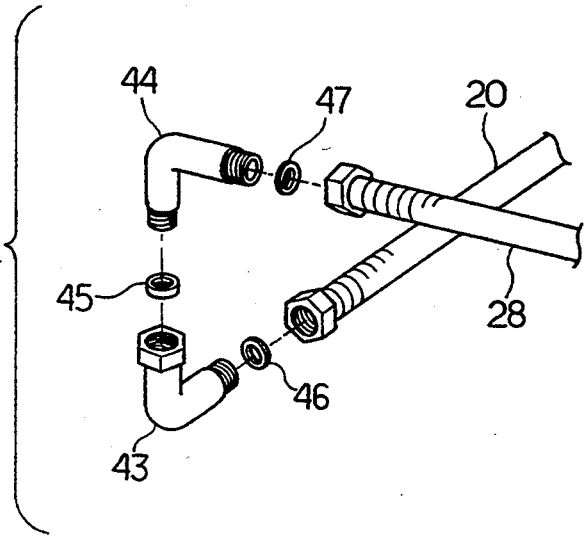

DISHWASHER WITH IMPROVED PIPING STRUCTURE

BACKGROUND OF THE INVENTION

1. Field of the Invention

This invention relates to a built-in type dishwasher which is built into an installation space previously provided in a kitchen unit such as a kitchen sink, and more particularly to a piping for such a dishwasher.

2. Description of the Prior Art

In conventional dishwashers of the above-mentioned type, a concave portion 2 is formed in the lower rear portion of a casing 1 and a piping duct 3 is provided in the casing 1 so as to be contiguous to the concave portion 2, as shown in FIGS. 18 and 19. Three types of piping are generally known for the above-described dishwasher. FIG. 20 illustrates the type in which a water supply pipe 6 from the water works and a sewer pipe 7 connected to the sewage work are previously drawn through the floor of the kitchen into an installation space 5 into which the dishwasher is built. FIG. 21 illustrates the type in which the water supply pipe 6 and the sewer pipe 7 are previously drawn through a wall of the kitchen into the installation space 5. FIG. 22 illustrates the type in which the water supply pipe 6 and the sewer pipe 7 are provided to extend on the floor of the kitchen. In each of these types, the casing 1 of the dishwasher is built into the installation space 5 so that the pipes 6, 7 are enclosed in the piping duct 3 through the concave portion 2. Thereafter, a lower cover closing a front opening is detached for the purpose of a piping work and then, ends of a main feed pipe and a main drain pipe (neither shown) disposed in the casing 1 are connected to ends of the pipes 6, 7, respectively.

In the above-described dishwasher, however, the water supply pipe 6 and the sewer pipe 7 needs to be previously drawn into the installation space 5 before the dishwasher is built into the same. A problem arises that these water supply pipe 6 and the sewer pipe 7 can be drawn into the installation space 5 only when a new house or building is built or when a house or building is enlarged or rebuilt. Furthermore, dimensions of the water supply pipe 6 and the sewer pipe 7 need to be strictly set at the time of construction of the house so that the pipes 6, 7 will be correctly enclosed in the piping duct 3 and connected to the main water supply and drain pipes in the casing 1, respectively when the dishwasher is installed. If these pipes should have any dimensional error, the house would need to be repaired, which poses a problem.

SUMMARY OF THE INVENTION

Therefore, an object of the present invention is to provide a dishwasher which can be built into a previously provided installation space without requiring strict dimensional accuracy between the dishwasher and the previously provided water supply pipe.

Another object of the invention is to provide a dishwasher wherein an installing work including a piping work can be performed readily even when the previously provided water supply pipe is located at either side of its installation space.

The present invention provides a dishwasher comprising a casing defining therein a wash chamber for accommodating tableware to be washed by application of wash liquid, the casing having right-hand and left-hand side walls and two concave portions formed in the lower portions of the side walls to be depressed inwardly, respectively. The concave portions have pipe passing openings formed in walls defining the concave portions, respectively. Each pipe passing opening is contiguous to the interior of the casing. The casing has a front wall having a working opening formed in a lower portion of the front wall. A main feed pipe is disposed in the casing and having two ends. The main feed pipe communicates with the wash chamber at one of the ends thereof and is disposed at the other end thereof in the lower forward region of the interior of the casing. A water supply connecting pipe has a part located in either one of the concave portions and is caused to pass through the pipe passing opening in the condition that said part thereof has been located in either concave portion so that one of two ends thereof is drawn into the casing and connected to the end of the main feed pipe located in the casing.

The main feed pipe of the dishwasher is connected to the water supply pipe previously provided around the installation space of the dishwasher in the following manner. The water supply connecting pipe is caused to pass through the pipe passing opening of either concave portion in the condition that a part of the water supply connecting pipe is located in the concave portion. In this condition, the end of the connecting pipe located in the dishwasher casing is connected to the end of the main feed pipe. The working opening of the casing is opened for the purpose of this connecting work. The other end of the connecting pipe located outside the casing is connected to the previously provided water supply pipe.

Since the length of the water supply connecting pipe can be selected, the location of the water supply pipe need not be limited. Consequently, the troublesome dimensional control of the piping between the dishwasher and the water supply pipe is not required, which simplifies the dishwasher installing work including the piping work.

Furthermore, the concave portions are formed in the right-hand and left-hand side walls of the casing respectively, and the pipe passing openings are formed in the walls defining the concave portions respectively. Consequently, the dishwasher installing work can be performed readily even when the previously provided water supply pipe is located at either right-hand or left-hand side of the installation space for the dishwasher.

The casing may have two piping ducts each disposed therein to extend longitudinally thereof and each piping duct may have an opening in a front end wall thereof and communicate at a rear end thereof with the corresponding pipe passing opening. In this construction, the distal end of the water supply pipe inserted into the pipe passing opening of either concave portion is guided by the piping duct when it is moved forward in the casing.

Two generally L-shaped joints may be connected between said other end of the main feed pipe located in the lower forward region of the casing interior and said end of the water supply connecting pipe in series with each other. Alternatively, a generally T-shaped joint may be connected between said other end of the main feed pipe and said end of the water supply connecting pipe. In each case, even when the water supply connecting pipe is guided through the pipe passing opening of either concave portion into the casing, it can be connected to an open end of the L-shaped or T-shaped joint which ends are directed to the direction in which the connecting pipe is guided into the casing. Consequently, the connecting pipe need not be bent to a large extent in the casing.

The invention may also be practiced as a dishwasher comprising a casing defining therein a wash chamber for accommodating tableware to be washed by application of wash liquid, the casing having right-hand and left-hand side walls and first and second concave portions formed in the lower portions of the side walls to be depressed inwardly, respectively and a third concave portion formed in the lower portion of a rear wall thereof to be depressed inwardly. The first, second and third concave portions have pipe passing openings formed in walls defining the concave portions, respectively. The third piping has both ends communicating with the first and second concave portions respectively, each pipe passing opening being contiguous to the interior of the casing, the casing having a front wall having a working opening formed in a lower portion of the front wall. A main feed pipe is disposed in the casing and has two ends. The main feed pipe communicates with the wash chamber at one of the ends thereof and is disposed at the other end thereof in the lower forward region of the interior of the casing. A water supply connecting pipe has a part located in either one of the first and second concave portions and is caused to pass through the pipe passing opening in the condition that said part thereof has been located in either one of the first and second concave portions so that one of two ends thereof is guided into the casing and connected to the end of the main feed pipe located in the casing. A main drain pipe extends through the pipe passing opening of the third concave portion so that one end thereof is located in the casing and communicates with the wash chamber. The main drain pipe has a portion located outside the casing. The portion extends so that a part thereof is located within the third concave portion.

In the above-described dishwasher, the main drain pipe can be previously set to a sufficient length. Consequently, the location of the sewer pipe need not be limited. Consequently, the troublesome dimensional control of the piping between the dishwasher and the sewer pipe is not required, which simplifies the dishwasher installing work including the piping work.

A generally V-shaped joint may be connected to the part of the main drain pipe located within the third concave portion so that a direction of the V-shaped joint is changed about an arm thereof. The V-shaped joint is employed for provision of a trap preventing odor from passing through the main drain pipe. The main drain pipe having extended out of the casing can be readily directed to either the first or the second concave portion by the V-shaped joint provided for shutoff of the odor when guided from the third concave portion.

BRIEF DESCRIPTION OF THE DRAWINGS

Other objects, features and advantages of the present invention will become clear upon reviewing the following description of preferred embodiments thereof, made with reference to the accompanying drawings, in which:

FIG. 10 is a partial perspective of a third embodiment of a dishwasher in accordance with the present invention;

FIG. 11 is an exploded view of a main feed pipe and a water supply connecting pipe connected as shown in FIG. 10;

DESCRIPTION OF THE PREFERRED EMBODIMENTS

Figure 1:
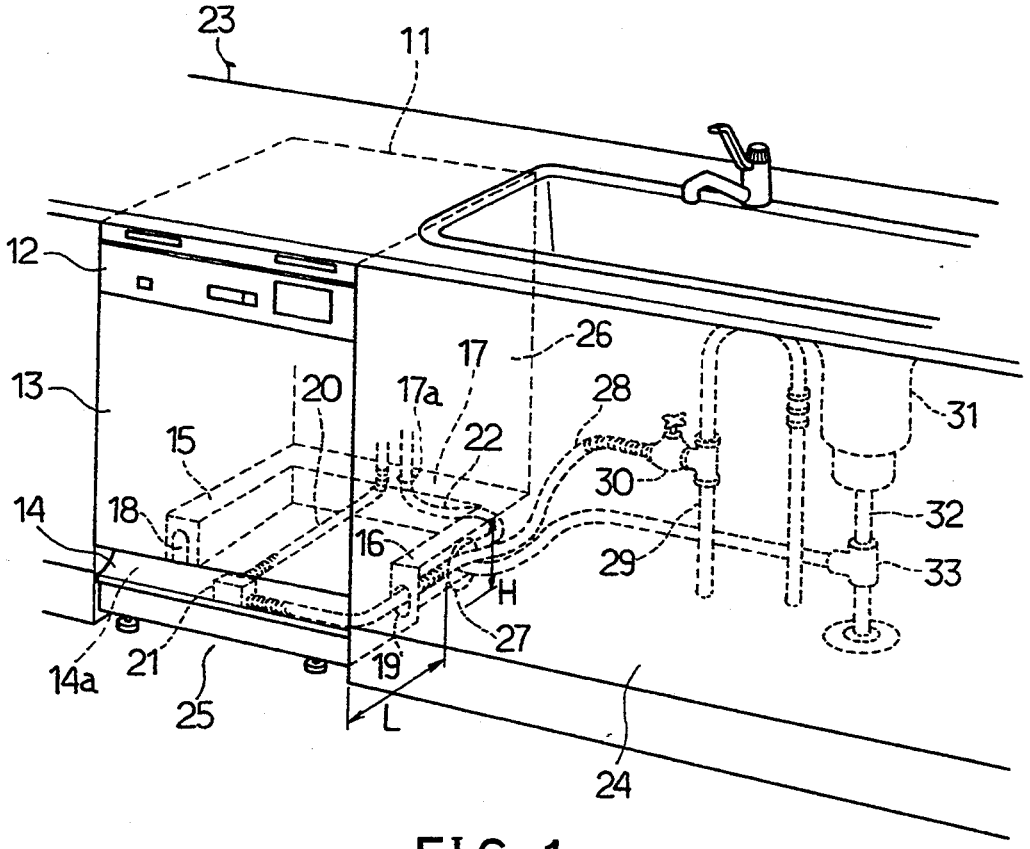
FIG. 1 is a perspective view of a first embodiment of a dishwasher built in the installation space of a sink unit in accordance with the present invention.

A first embodiment of the present invention will be described with reference to FIGS. 1 to 8. Referring to FIG. 5, a dishwasher in accordance with the invention comprises a casing 11 having therein a wash chamber **11*a* for accommodating tableware to be washed and a spraying device (not shown) for spraying the tableware with the wash liquid, thereby washing the tableware, as well known in the art. The dishwasher further has on the front of the casing 11 an operation panel 12, a door 13 and a cover 14. The cover 14 is detachably attached on the lowest front of the casing 11 to close and open a working opening 14*a* formed in the lower front of the casing 11**.

Referring now to FIGS. 5 to 8, three concave portions 15, 16 and 17 are formed in lower portions of left-hand and right-hand side walls and a rear wall of the casing 11, respectively. Each of the concave portions 15–17 are depressed inwardly of the casing 11. The concave portions 15 and 16 extend from the rear ends of the left-hand and right-hand side walls, terminating at the middle of the walls, respectively. Each of the concave portions 15 and 16 is open at an outer side and the underside. The rear concave portion 17 is contiguous to both side concave portions 15, 16 and open at its rear and underside. Two longitudinal slit-like pipe passing openings 18 and 19 are formed in front end walls defining the left-hand and right-hand concave portions 15, 16, respectively. Each of the pipe passing openings 18, 19 communicate with the interior of the casing 11.

A main feed pipe 20 is provided outside the bottom wall of the wash chamber 11*a* in the casing 11, as well known in the art. One of two ends of the main feed pipe 20 is connected to a water supply valve (not shown) provided in the rear wall of the wash chamber so that water is supplied into the wash chamber. The other end of the main feed pipe 20 is located at the lower central front in the interior of the casing 11 to be connected to a mouth of a joint 21.

A main drain pipe 22 is provided outside the peripheral wall of the wash chamber 11*a* in the casing 11, as well known in the art. The main drain pipe 22 is connected at one end thereof located in the casing 11 to a drainage pump (not shown) provided for draining the wash liquid in the wash chamber 11*a*. The other end of the main drain pipe 22 extends outside the casing 11 through a pipe passing opening 17*a* formed in an upper wall defining the rear concave portion 17.

Figure 2:
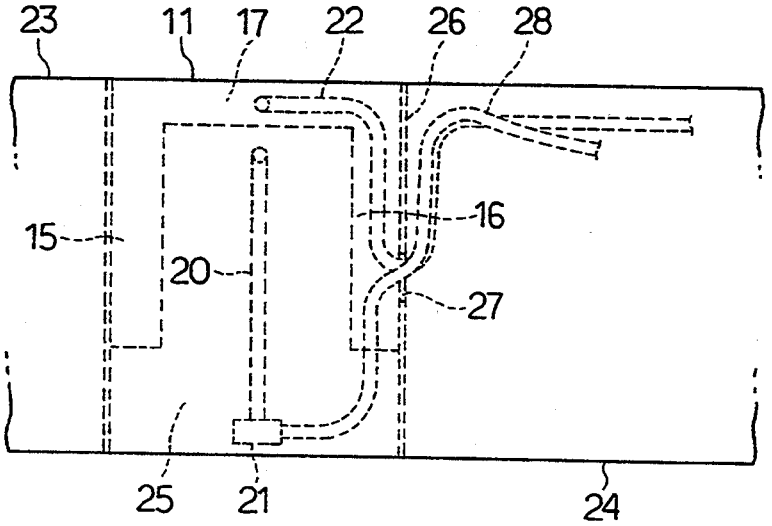
FIG. 2 is a top plan view of the dishwasher built in the installation space of the sink unit.

In installation of the above-described dishwasher, a piping hole 27 is first formed in a lower portion of a right-hand side wall 26 defining an installation space 25 when the space 25 is located on the left of a kitchen sink 24 of a sink unit 23, as shown in FIGS. 1 and 2. One end of a water supply connecting pipe 28 located in the sink 24 is drawn through the piping hole 27 and further drawn approximately 60 centimeters from the hole 27 to the forward area of the installation space 25. The distal end of the main drain pipe 22 extending outside the dishwasher casing 11 is drawn through the piping hole 27 into the sink 24. In this state, the casing 11 is gradually pushed into the installation space. During this step, the end of the connecting pipe 28 located in the installation space 25 is guided into the right-hand concave portion 16 and then, is drawn through the opening 19 into the casing 11 while the main drain pipe 22 extending outside the casing 11 is caused to extend along the rear and right-hand concave portions 17, 16 and drawn through the piping hole 27 into the sink 24.

The cover 14 closing the working opening 14*a* is detached from the casing 11 when the casing 11 is pushed into the installation space 25 such that the front face of the casing 11 is planar with the front face of the sink unit 23. The end of the connecting pipe 28 located in the forward area in the casing 11 is connected to the other mouth of the joint 21, which mouth is at a right angle with the mouth thereof to which the main feed pipe 20 is connected. Thereafter, the cover 14 is attached to the casing 11 to close the working opening 14*a*.

The end of the connecting pipe 28 is connected to a bifurcated cock 30 further connected to a water supply pipe 29. The end of the main drain pipe 22 is connected to a Y-shaped or V-shaped joint 33 provided below a duster pot 31, the joint 33 being further connected to a sink drain pipe serving as a sewer pipe.

Figure 3:
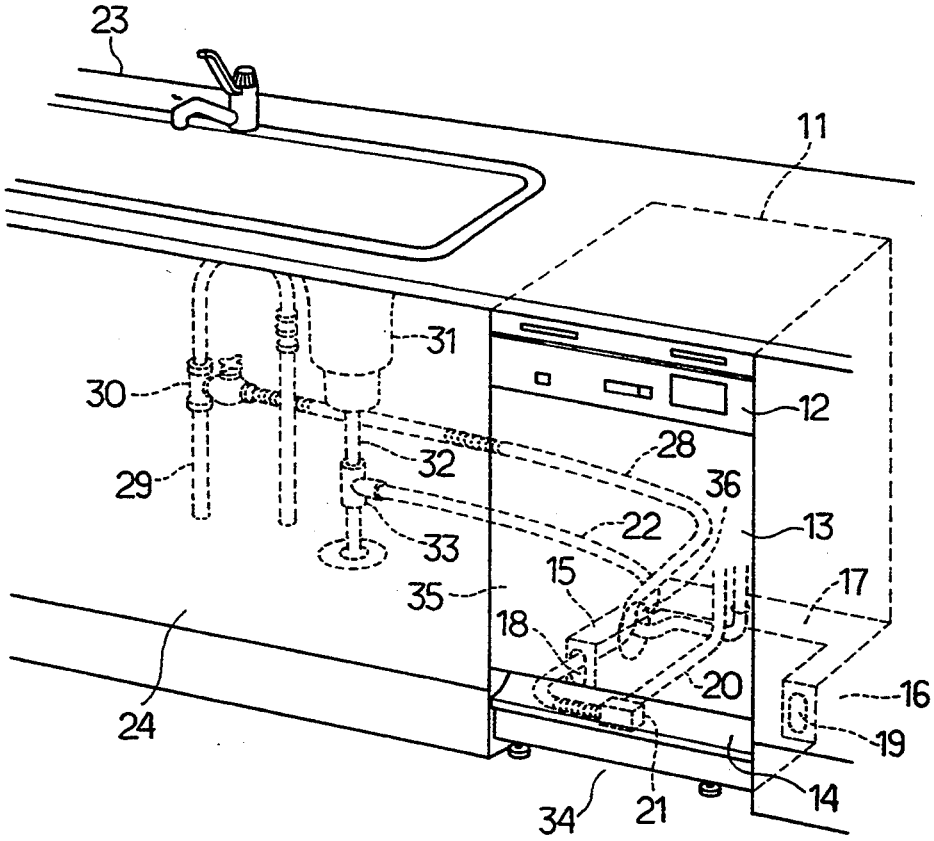
FIG. 3 is a perspective view of the dishwasher built in another installation space of the sink unit.
Figure 4:
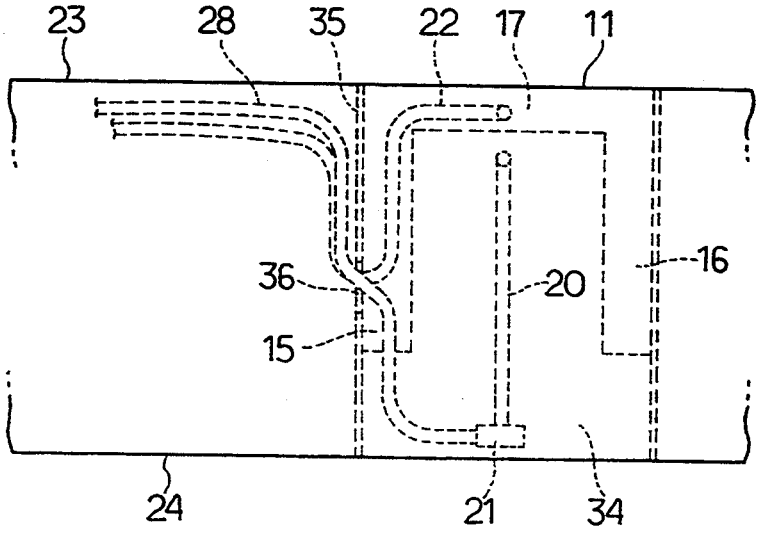
FIG. 4 is top plan view of the dishwasher shown in FIG. 3.
Figure 5:
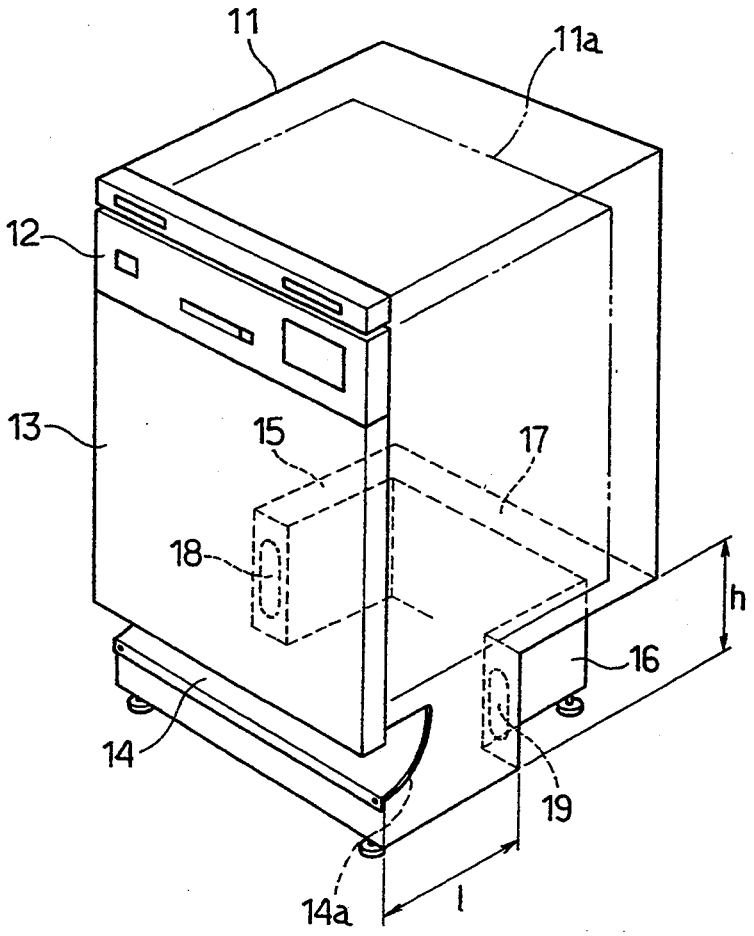
FIG. 5 is a perspective view of the dishwasher shown in FIG. 1.
Figure 6:
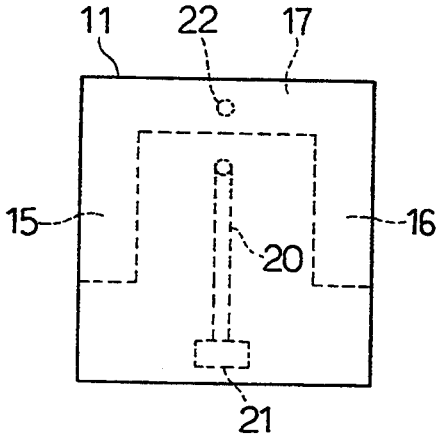
FIG. 6 is a top plan view of the dishwasher shown in FIG. 1.
Figure 7:
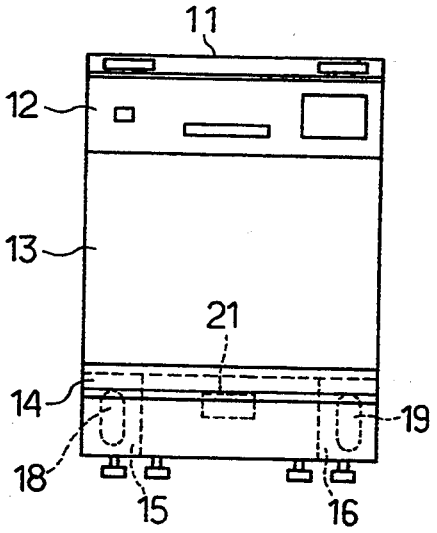
FIG. 7 is a front view of the dishwasher.
Figure 8:
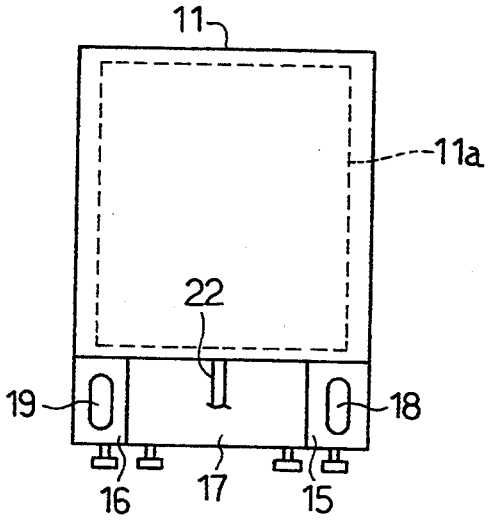
FIG. 8 is a rear view of the dishwasher.

On the other hand, a piping hole 36 is formed in a left-hand side wall defining an installation space 34 when the installation space is located on the right of the kitchen sink 24 of the sink unit 23, as shown in FIGS. 3 and 4. The connecting pipe 28 is drawn through the piping hole 36, the left-hand concave portion 15 and the pipe passing opening 18 sequentially into the casing 11. The main drain pipe 22 is drawn out through the piping hole 36 into the sink 24. Thereafter, the same installation work as described above is performed.

According to the above-described embodiment, the necessary piping can be performed simultaneously when the dishwasher is installed. The water supply and sewer pipes need not be previously provided when a house or building is constructed or reconstructed. Furthermore, the dimensions of the water supply and sewer pipes need not be strictly set, and the piping can be performed readily.

Substantially the same piping is performed when the installation space is located at either side of the kitchen sink 24 of the kitchen unit 23. Thus, the dishwasher can be readily installed at either side of the sink. Additionally, as obvious from the foregoing, the dishwasher can be applied to various types of piping of the water supply and sewer systems. Consequently, a little modification is required when the installation space for the dishwasher is provided in an existing sink unit. Thus, so-called post installation of the dishwasher can be readily performed.

In the foregoing embodiment, it is desirable that the length L (see FIG. 1) from the front face of the sink unit 23 to the front edge of the piping hole 27 or 36 is so set as to be equal to the length 1 (see FIG. 5) from the front face of the casing 11 to the front end wall defining the concave portion 15 or 16 or above. Furthermore, it is desirable that the height H (see FIG. 1) from the bottom face of the sink unit 23 to the upper edge of the piping hole 27 is equal to the height h (see FIG. 5) from the lowest end of the casing 11 to the upper wall of the concave portion 15 or 16 or below. As the result of setting of the length L and the height H as described above, the connecting pipe 28 can be smoothly led into the casing 11 and the main drain pipe 22 can be smoothly led out into the sink 24 since the piping holes 27, 36 are located in the spaces of the concave portions 15, 16 respectively.

Figure 9:
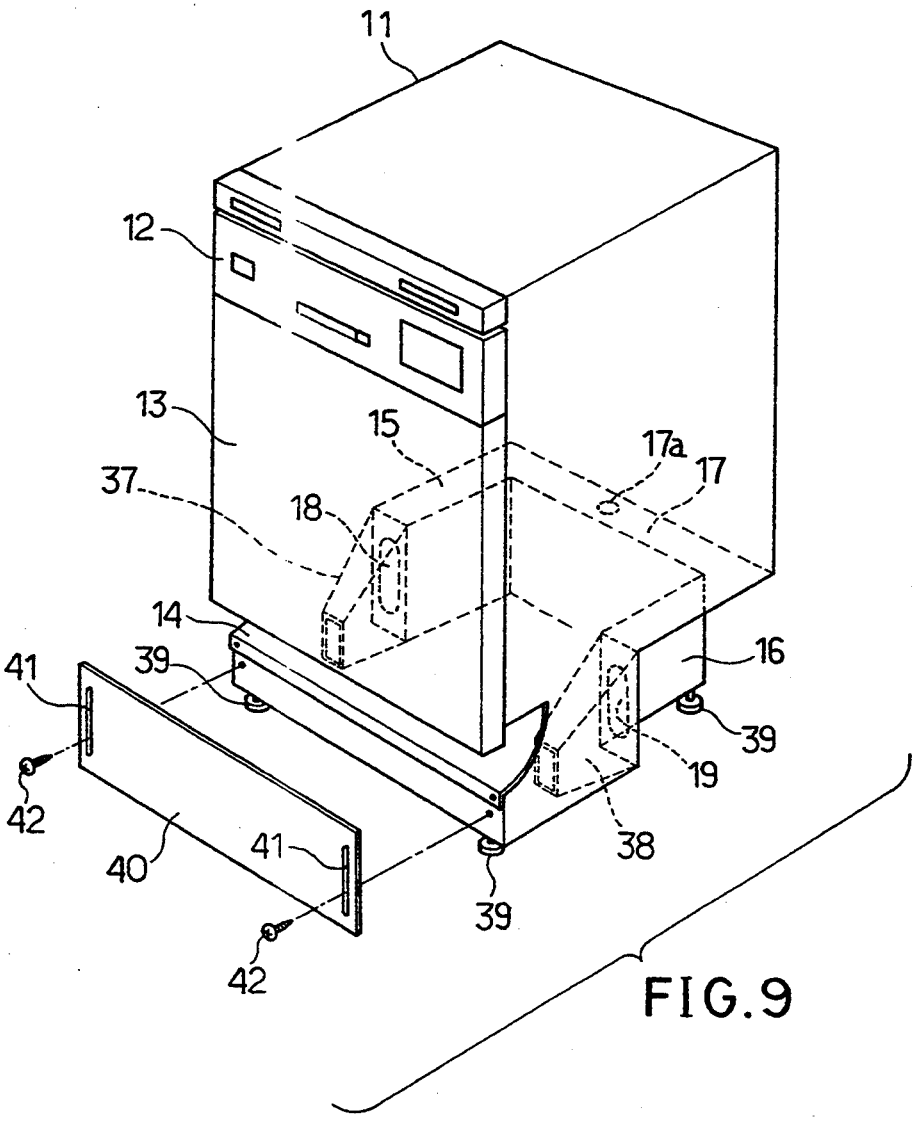
FIG. 9 is a partially exploded perspective view of a second embodiment of a dishwasher in accordance with the present invention.

FIG. 9 illustrates a second embodiment of the invention. Two piping ducts 37 and 38 are provided in the casing 11 to extend forward from the front end walls defining the concave portions 15, 16 and having the pipe passing openings 18, 19, respectively. The connecting pipe 28 is guided by the piping duct 37 or 38 when drawn into the casing 11. Consequently, the connecting pipe 28 can be smoothly led into the casing 11. Each of the piping ducts 37, 38 is tapered such that the connecting pipe 28 can be led to a target position thereof in the casing 11 more reliably.

Furthermore, the casing 11 has four legs 39 mounted on the corners of the outer bottom thereof. The length of each leg 39 can be adjusted by its screw-in structure. As the result of provision of the legs 39, the height of the casing 11 can be adjusted so that the lower edge of the door 13 is planar with those of doors of the sink unit and those of other front panels.

Additionally, a front skirt cover 40 is attached to the lowest front of the casing 11 by two vertically long holes 41 and two screws 42 inserted into the respective holes 41 so that the position of the cover 40 is vertically adjusted. The legs 39 can be covered by the front skirt cover 40.

FIGS. 10 and 11 illustrate a third embodiment of the invention. Two L-shaped joints 43 and 44 are connected to the end of the main feed pipe 20 in series with each other. The connecting pipe 28 is connected to the L-shaped joint 44. When the L-shaped joint 44 is turned to a different direction, the direction in which the connecting pipe 28 is drawn into the casing 11 can be readily selected in accordance with the location of the water supply pipe. Consequently, the connecting pipe 28 can be prevented from being turned to another different direction in the casing 11.

Furthermore, a filter 45 is interposed between the L-shaped joints 43, 44, as shown in FIG. 11. The filter 45 can be skillfully interposed by using the above-described construction for connecting the pipe 28 to the L-shaped joint 44. The filter 45 has an outer peripheral portion formed of rubber or synthetic resin. Thus, when held between the L-shaped joints 43, 44, the filter 45 serves as a packing. A packing 46 is held between the L-shaped joint 43 and the main feed pipe 20 and another packing 47 is held between the L-shaped joint 44 and the connecting pipe 28.

Figure 12:
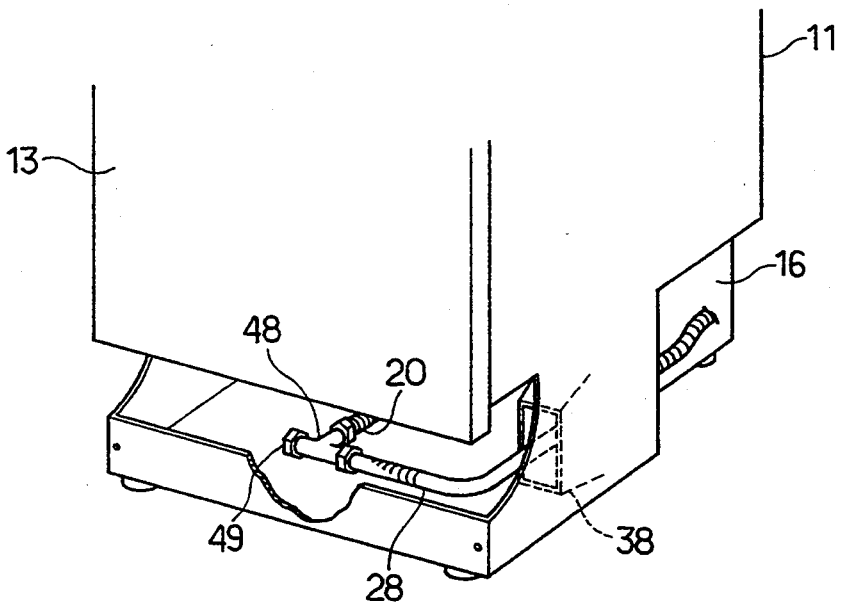
FIG. 12 is a view similar to FIG. 4 showing a fourth embodiment of a dishwasher in accordance with the present invention.
Figure 13:
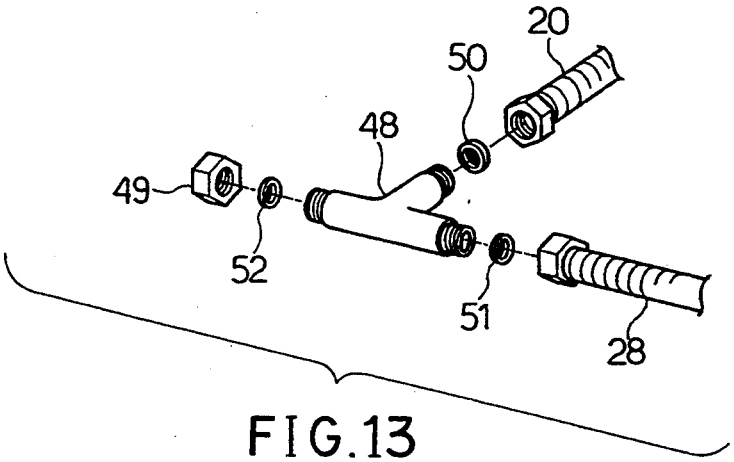
FIG. 13 is a view similar to FIG. 11 showing the fourth embodiment of the dishwasher.

FIGS. 12 and 13 illustrate a fourth embodiment. A T-shaped joint 48 is connected to the end of the main feed pipe 20. The end of the connecting pipe 28 is connected to one of two distal open ends of the T-shaped joint 48. A cap 49 is attached to the other distal open end of the T-shaped joint 49, thereby closing the same. In the fourth embodiment, too, the direction in which the connecting pipe 28 is drawn into the casing 11 can be readily selected.

A filter 50 is interposed between the T-shaped joint 48 and the main feed pipe 20. A packing 51 is held between the T-shaped joint 48 and the connecting pipe 28 and another packing 52 is held between the T-shaped joint 48 and the cap 49.

Figure 14:
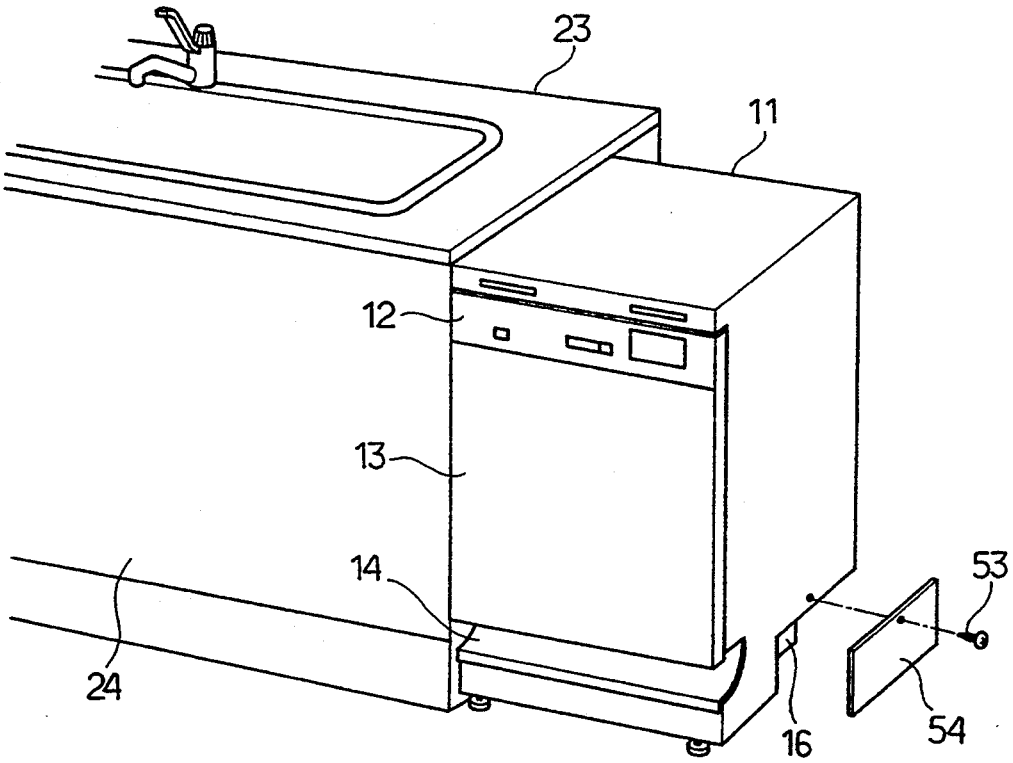
FIG. 14 is a partially exploded perspective view of a fifth embodiment of a dishwasher in accordance with the present invention.

FIG. 14 illustrates a fifth embodiment. The dishwasher and the sink unit 23 are installed side by side in the fifth embodiment. The casing 11 of the dishwasher is provided with a cover 54 for covering one of the left-hand and right-hand concave portions 15, 16. The cover 54 is attached to the casing 11 by a screw 53. Consequently, the interior of either concave portion 15 or 16 can be kept from sight. The cover 54 may be attached to the casing 11 by an elastic engagement claw, instead of the screw 53.

Figure 15:
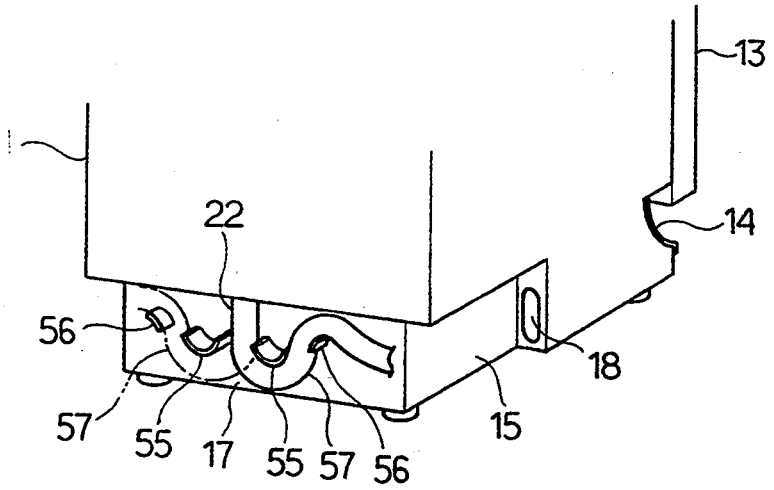
FIG. 15 is a partial rear perspective view of a sixth embodiment of a dishwasher in accordance with the present invention.

FIG. 15 illustrates a sixth embodiment. Two guide protrusions 55 and other two guide protrusions 56 are provided on the wall defining the rear concave portion 17. The main drain pipe 22 extended out of the casing 11 is bent along the guide protrusions 55, 56 into a U-shape, thereby providing a trap 57 preventing back flow of odor from the house drainage system to which the sewer pipe is connected. Thus, the trap 57 can be provided only by the piping structure of the main drain pipe 22.

Figure 16:
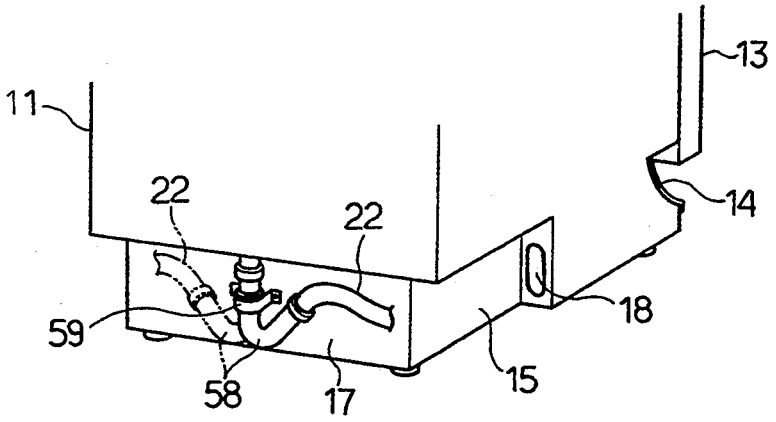
FIG. 16 is a view similar to FIG. 15 showing a seventh embodiment of a dishwasher in accordance with the present invention.

FIG. 16 illustrates a seventh embodiment. One of arms of a V-shaped joint 58 is rotatably mounted on the rear wall defining the rear concave portion 17 by a presser band 59 such that the other arm thereof can be turned to the left-hand and right-hand sides. The main drain pipe 22 is connected to the V-shaped joint 58. Consequently, the V-shaped joint 58 for switching the direction in which the main drain pipe 22 is drawn out of the casing 11 provides for the odor trapping effect.

Figure 17:
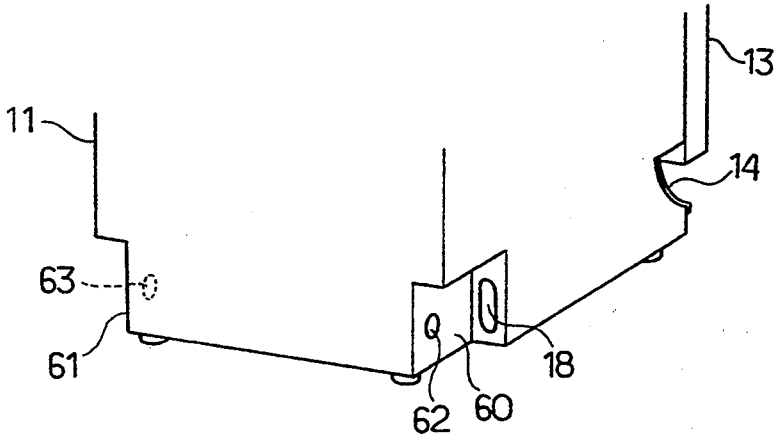
FIG. 17 is also a view similar to FIG. 15 showing an eighth embodiment of a dishwasher in accordance with the present invention.
Figure 18:
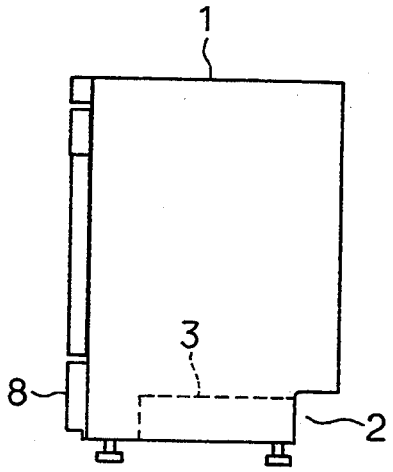
FIG.18 PRIOR ART
FIG. 18 is a side view of a conventional dishwasher.
Figure 19:
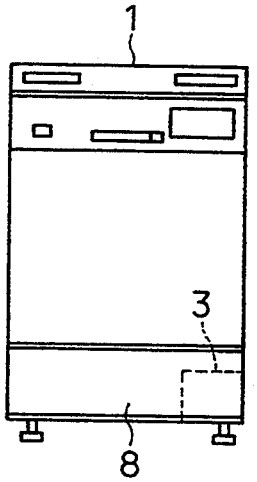
FIG.19 PRIOR ART
FIG. 19 is a front view of the conventional dishwasher.
Figure 20:
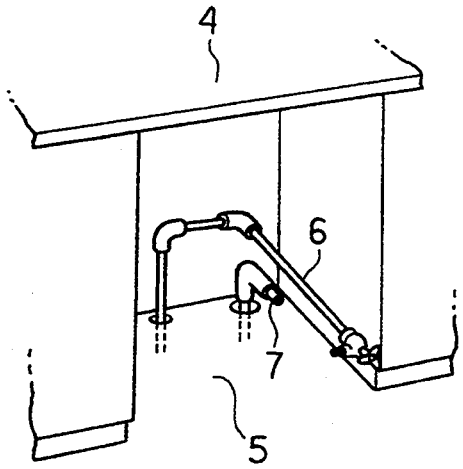
FIG. 20 PRIOR ART
FIG. 20 is a partial perspective view of a sink unit with an installation space for a dishwasher for showing one type of conventional piping for the dishwasher.
Figure 21:
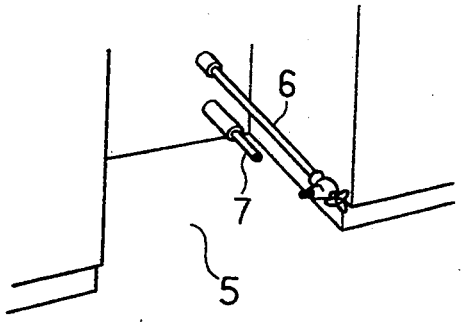
FIG. 21 PRIOR ART
FIG. 21 is also a partial perspective view of the sink unit for showing another type of conventional piping.
Figure 22:
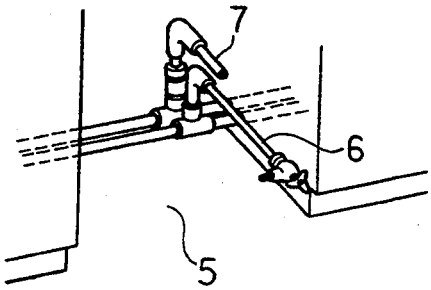
FIG. 22 PRIOR ART
FIG. 22 is also a partial perspective view of the sink unit for showing further another type of conventional piping.

FIG. 17 illustrates an eighth embodiment. The concave portions 60, 61 are formed in the lower side walls in the vicinity of the rear wall of the casing 11, respectively. The rear concave portion is not provided in the eighth embodiment. The connecting pipe is drawn into the casing 11 through one of the pipe passing openings 18, 19 formed in the walls defining the concave portions 60, 61, respectively. The drain pipe is drawn out of the casing 11 through one of openings 62, 63 formed in the side walls defining the concave portions 60, 61, respectively.

The foregoing description and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

We claim:

1. A dishwasher comprising:

a) a casing defining therein a wash chamber for accommodating tableware to be washed by application of wash liquid, the casing having right-hand and left-hand side walls and two concave portions formed in lower portions of the side walls to be depressed inwardly, respectively, the concave portions having pipe passing openings formed in walls defining the concave portions, respectively, each pipe passing opening being contiguous to the interior of the casing, the casing having a front wall having a working opening formed in a lower portion of the front wall;

b) a main feed pipe disposed in the casing and having two ends, the main feed pipe communicating with the wash chamber at one of the ends thereof and being disposed at the other end thereof in the lower forward region of the interior of the casing; and c) a water supply connecting pipe having a part located in either one of the concave portions and caused to pass through the pipe passing opening in the condition that said part thereof has been located in either concave portion so that one of two ends thereof is drawn into the casing and connected to the end of the main feed pipe located in the casing.

2. A dishwasher according to claim 1, wherein the casing has two piping ducts each disposed therein to extend longitudinally thereof, each piping duct having an opening in a front end wall thereof and communicating at a rear end thereof with the corresponding pipe passing opening.

3. A dishwasher according to claim 2, wherein each piping duct is formed into a generally tapered configuration so as to have a forward portion slenderer than a rear portion.

4. A dishwasher according to claim 1 , wherein two generally L-shaped joints are connected between said other end of the main feed pipe located in the lower forward region of the casing interior and said end of the water supply connecting pipe in series with each other.

5. A dishwasher according to claim 4, wherein a filter is interposed between the L-shaped joints.

6. A dishwasher according to claim 1 , wherein a generally T-shaped joint is connected between said other end of the main feed pipe and said end of the water supply connecting pipe.

7. A dishwasher according to claim 1, wherein a cover is provided for covering either one of the convex portions.

8. A dishwasher comprising:

a) a casing defining therein a wash chamber for accommodating tableware to be washed by application of wash liquid, the casing having right-hand and left-hand side walls and first and second concave portions formed in lower portions of the side walls to be depressed inwardly, respectively and a third concave portion formed in a lower portion of a rear wall thereof to be depressed inwardly, the first, second and third concave portions having pipe passing openings formed in walls defining the concave portions, respectively, the third piping having both ends communicating with the first and second concave portions respectively, each pipe passing opening being contiguous to the interior of the casing, the casing having a front wall having a working opening formed in a lower portion of the front wall;

b) a main feed pipe disposed in the casing and having two ends, the main feed pipe communicating with the wash chamber at one of the ends thereof and being disposed at the other end thereof in the lower forward region of the interior of the casing;

c) a water supply connecting pipe having a part located in either one of the first and second concave portions and caused to pass through the pipe passing opening in the condition that said part thereof has been located in either one of the first and second concave portions so that one of two ends thereof is guided into the casing and connected to the end of the main feed pipe located in the casing; and d) a main drain pipe extending through the pipe passing opening of the third concave portion so that one end thereof is located in the casing and communicates with the wash chamber, the main drain pipe having a portion located outside the casing, the portion extending so that a part thereof is located within the third concave portion.

9. A dishwasher according to claim 8, wherein a generally V-shaped joint is connected to the part of the main drain pipe located within the third concave portion so that a direction of the V-shaped joint is changed about an arm thereof.

* * * * *